United States Patent [19]

Ono et al.

[11] 3,999,989

[45] Dec. 28, 1976

[54] ELECTROPHOTOGRAPHIC MEMBER HAVING IMPROVED SENSITIZER AND PROCESS UTILIZING SAME

[75] Inventors: Hisatake Ono; Syu Watarai; Chiaki Osada, all of Asaka, Japan

[73] Assignee: Fuji Photo Film Co., Ltd., Kanagawa, Japan

[22] Filed: Jan. 25, 1974

[21] Appl. No.: 436,712

Related U.S. Application Data

[62] Division of Ser. No. 209,225, Dec. 17, 1971, abandoned.

[30] Foreign Application Priority Data

Dec. 19, 1970 Japan ..... 45-114703

[52] U.S. Cl. ..... 96/1.6; 96/90 PC; 260/326.11 S

[51] Int. Cl.[2] ..... G03G 5/06; G03G 13/22

[58] Field of Search ..... 96/1.6, 90 PC; 260/326.11 IS

[56] References Cited

UNITED STATES PATENTS

| | | | |
|---|---|---|---|
| 3,100,778 | 8/1963 | Berman | 96/90 PC |
| 3,113,022 | 12/1963 | Cassiers et al. | 96/1.5 |
| 3,445,225 | 5/1969 | Brynko et al. | 96/116 |
| 3,660,086 | 5/1972 | Tamai et al. | 96/90 PC |
| 3,667,949 | 6/1972 | Ihoue | 96/90 PC |
| 3,782,933 | 1/1974 | Ohlschlager et al. | 96/1.6 |
| 3,799,773 | 3/1974 | Watarai et al. | 96/90 PC |
| 3,832,172 | 8/1974 | Nishide et al. | 96/1.6 |
| 3,844,782 | 10/1974 | Riester et al. | 96/1.6 |
| 3,852,067 | 12/1974 | Levy | 96/1.6 |
| 3,879,197 | 4/1975 | Bartlett et al. | 96/1.6 |
| 3,933,509 | 1/1976 | Noguchi et al. | 96/90 PC |

OTHER PUBLICATIONS

Arnold et al., Chem. Abs. vol. 67: 65385g 1967, abs. of Tetrahedron Letters 1967, 2105–2107.

Nakayama et al., Chem. Abs. vol. 73, 92628u 1970, Abs. of Bull. Chem. Soc. Jap. 1970, 2248.

*Primary Examiner*—Charles L. Bower, Jr.

*Attorney, Agent, or Firm*—Gerald J. Ferguson, Jr.; Joseph J. Baker

[57] ABSTRACT

A photosensitizer for electrophotographic photosensitive materials comprising inorganic or organic acid salts of indoline spirobenzopyranes of the formula $R_1$, R hd 2, $R_3$, X and Y are defined in the specification.

10 Claims, 4 Drawing Figures

ELECTROPHOTOGRAPHIC MEMBER HAVING IMPROVED SENSITIZER AND PROCESS UTILIZING SAME

This is a division of application Ser. No. 209,225 filed Dec. 17, 1971 now abandoned.

BACKGROUND OF THE INVENTION

1. Field of the Invention

The present invention relates to sensitizers for electrophotographic photosensitive materials using organic compounds as a photoconductive material.

2. Description of the Prior Art

In electrophotographic processes using organic photoconductive materials, one of the most important factors influencing the photosensitivity is the sensitizer present. Usually, polyvinylheterocyclic compounds such as poly-N-vinylcarbazole, polycyclic aromatic vinyl polymers such as polyvinylanthracene, low molecular weight compounds with a heterocyclic ring such as an oxazole ring or a thiazole ring, and the like are used as photoconductive materials for electrophotography. However, none of them are found to have enough photosensitivity.

SUMMARY OF THE INVENTION

The present invention relates to an entirely new sensitizer added to organic photoconductive materials to improve both the photosensitivity thereof and their photosensitive wave length region which is a quaternary salt of an indoline spirobenzopyrane derivative with an inorganic or organic acid having the general formula

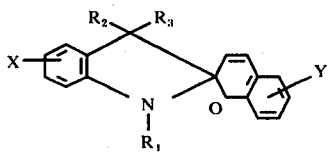

where $R_1$: an alkyl radical with one to five carbon atoms, a substituted alkyl radical with one to five carbon atoms (the substituent is a carboxyl radical, a cyano radical, an alkoxycarbonyl radical with one to five carbon atoms, a hydroxy radical, a halogen atom, an alkoxy radical with one to five carbon atoms, or a phenyl radical), or a phenyl radical $R_2$, $R_3$: an alkyl radical with one to five carbon atoms, a phenyl radical, or $R_2$+$R_3$: $(CH_2)_n$ ($n$=4,5)

X: a hydrogen atom, a nitro radical, a halogen atom, a carboxyl radical, an alkoxycarbonyl radical with one to five carbon atoms, an alkyl radical with one to five carbon atoms, or an alkoxy radical with one to five carbon atoms Y: a hydrogen atom, a nitro radical, a halogen atom, a formyl radical, or an alkoxy radical with one to five carbon atoms.

Thus, it is a primary object of this invention to provide an improved sensitizer for various organic, photoconductive materials to improve the sensitivity thereof and/or extend the wavelength range of photosensitivity.

Other objects and advantages of this invention will become apparent upon reading the appended claims in conjunction with the following detailed description and the attached drawing.

DETAILED DESCRIPTION OF THE INVENTION

Figure 1:
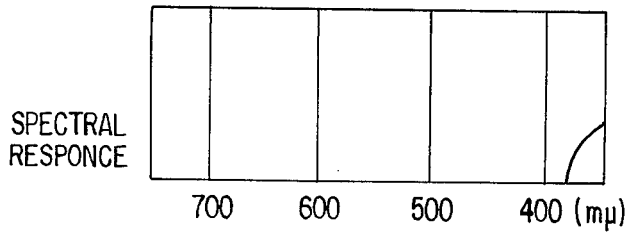
FIG. 1 illustrates the spectral sensitivity curve of unsensitized poly-N-vinylcarbazole, FIG. 2 that of poly-N-vinylcarbazole with 1,3,3-trimethyl-6′-nitrospiro(indoline-2,2′H-chromene) added, and FIGS. 3 and 4 those of sensitizers according to the present invention.

These quaternary salts of indoline spirobenzopyrane derivative are easily obtained by adding an organic or inorganic acid to the corresponding indoline spirobenzopyrane compounds dissolved in an organic solvent. The solvent may be a lower primary alcohol such as methanol, ethanol, butanol, etc., and mixtures thereof, or an aliphatic hydrocarbon such as benzene, toluene, xylene, etc., and mixtures thereof. Indoline spirobenzopyrane compounds are known to exhibit photochromism, and various kinds of such compounds have already been synthesized.

Examples of compounds within the invention are as follows.

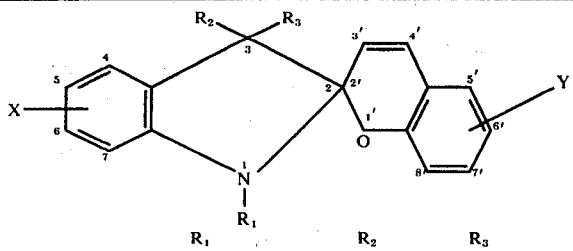

| | | $R_1$ | $R_2$ | $R_3$ | X | Y |
|---|---|---|---|---|---|---|
| 1. | 1,3,3-trimethylspiro-(indoline-2,2′-2′H-chromene) | $-CH_3$ | $-CH_3$ | $-CH_3$ | — | — |
| 2. | 1,3,3-trimethyl-8′-formylspiro- (indoline-2,2′-2′-H-chromene) | $-CH_3$ | $-CH_3$ | $-CH_3$ | — | -8′-CHO |
| 3. | 1,3,3-trimethyl-6′,8′-dichlorospiro(indoline-1,1′-2′-H-chromene) | $-CH_3$ | $-CH_3$ | $-CH_3$ | — | -6′-Cl -8′-Cl -3′-Cl |
| 4. | 1,3,3-trimethyl-8′-methoxyspiro-(indoline-2,2′-2′H-chromene) | $-CH_3$ | $-CH_3$ | $-CH_3$ | — | -8′-$OCH_3$ |

-continued

| | | | | | | |
|---|---|---|---|---|---|---|
| 5. | 1,3,3-trimethyl-6'-nitrospiro-(indoline-2,2'-2'H-chromene) | $-CH_3$ | $-CH_3$ | $-CH_3$ | — | -6'-$NO_2$ |
| 6. | 1,3,3-trimethyl-6',8'-dibromo-spiro(indoline-2,2'-2'H-chromene) | $-CH_3$ | $-CH_3$ | $-CH_3$ | — | -6'-Br -8'-Br |
| 7. | 1,3,3-trimethyl-5',7'-dichloro-6'-nitrospiro (indoline-2,2'-2'H-chromene) | $-CH_3$ | $-CH_3$ | $-CH_3$ | — | -5'-Cl -6'-$NO_2$ -7'-Cl |
| 8. | 1,3,3-trimethyl-8'-formyl-6'-nitrospiro(indoline-2,2'-2'H-chromene) | $-CH_3$ | $-CH_3$ | $-CH_3$ | — | -6'-$NO_2$ -8'-CHO |
| 9 | 1,3,3-trimethyl-8'-methoxy-6'-nitrospiro (indoline-2,2'-2'H-chromene) | $-CH_3$ | $-CH_3$ | $-CH_3$ | — | -6'-$NO_2$ -8'-$OCH_3$ |
| 10. | 1-ethyl-3,3-dimethyl-6'-nitrospiro(indoline-2,2'-2'H-chromene) | $-C_2H_5$ | $-CH_3$ | $-CH_3$ | — | -6'-$NO_2$ |
| 11. | 1-propyl-3,3-dimethyl-6'-nitrospiro(indoline-2,2'-2'H-chromene) | $-C_3H_7$ | $-CH_3$ | $-CH_3$ | — | -6'-$NO_2$ |
| 12. | 1-buthyl-3,3-dimethyl-6'-nitrospiro(indoline-2,2'-2'H-chromene) | $-C_4H_9$ | $-CH_3$ | $-CH_3$ | — | -6'-$NO_2$ |
| 13. | 1,3,3-trimethyl-5-methyl-6'-nitrospiro(indoline-2,2'-2'H-chromene) | $-CH_3$ | $-CH_3$ | $-CH_3$ | -5-$CH_3$ | -6'-$NO_2$ |
| 14. | 1,3,3-trimethyl-5-methyl-8'-methoxy-6'-nitro-spiro-(indoline-2,2'-2'H-chromene) | $-CH_3$ | $-CH_3$ | $-CH_3$ | -5-$CH_3$ | -6'-$NO_2$ -8'-$OCH_3$ |
| 15. | 1,3,3-trimethyl-5-methyl-5',7'-dichloro-6'-nitrospiro-(indoline-2,2'-2'H-chromene) | $-CH_3$ | $-CH_3$ | $-CH_3$ | -5-$CH_3$ | -5'-Cl -6'-$NO_2$ -7'-Cl |
| 16. | 1,3,3-trimethyl-5-methoxy-spiro(indoline-2,2'-2'H-chromene) | $-CH_3$ | $-CH_3$ | $-CH_3$ | -5-$OCH_3$ | — |
| 17. | 1,3,3-trimethyl-5-methoxy-6'-nitrospiro(indoline-2,2'-2'H-chromene) | $-CH_3$ | $-CH_3$ | $-CH_3$ | -5-$OCH_3$ | -6'-$NO_2$ |
| 18. | 1,3,3-trimethyl-5-methoxy-8'-methoxy-6'-nitro-spiro-(indoline-2,2'-2'H-chromene) | $-CH_3$ | $-CH_3$ | $-CH_3$ | -5-$OCH_3$ | -6'-$NO_2$ -8'-$OCH_3$ |
| 19. | 1,3,3-trimethyl-5-chloro-spiro-(indoline-2,2'-2'H-chromene) | $-CH_3$ | $-CH_3$ | $-CH_3$ | -5-Cl | — |
| 20. | 1,3,3-trimethyl-5-chloro-6'-nitrospiro(indoline-2,2'-2'H-chromeme) | $-CH_3$ | $-CH_3$ | $-CH_3$ | -5-Cl | -6'-$NO_2$ |
| 21. | 1,3,3-trimethyl-5-chloro-8'-methoxy-6'-nitrospiro-(indoline-2,2'-2'H-chromene) | $-CH_3$ | $-CH_3$ | $-CH_3$ | -5-Cl | -6'-$OCH_3$ -8'-$NO_2$ |
| 22. | 1,3,3-trimethyl-5-chloro-6',8'-dibromospiro(indoline-2,2'-2'H-chromene) | $-CH_3$ | $-CH_3$ | $-CH_3$ | -5-Cl | -6'-Br -8'-Br |
| 23. | 1,3,3-trimethyl-5-nitro-spiro(indoline-2,2'-2-H-chromene) | $-CH_3$ | $-CH_3$ | $-CH_3$ | -5-$NO_2$ | — |
| 24. | 1,3,3-trimethyl-5,6'-dinitrospiro(indoline-2,2'-2'H-chromene) | $-CH_3$ | $-CH_3$ | $-CH_3$ | -5-$NO_2$ | -6'-$NO_2$ |
| 25. | 1,3,3-trimethyl-5,6'-dinitro-8'-methoxyspiro-(indoline-2,2'-2'H-chromene) | $-CH_3$ | $-CH_3$ | $-CH_3$ | -5-$NO_2$ | -6'-$NO_2$ -8'-$OCH_3$ |
| 26. | 1,3,3-trimethyl-5-nitro-6',8'-dibromospiro(indoline-2,2'-2'H-chromene) | $-CH_3$ | $-CH_3$ | $-CH_3$ | -5-$NO_2$ | -6'-Br -8'-Br |
| 27. | 1,3,3-trimethyl-5-ethoxycarbonyl-6'-nitrospiro(indoline-2,2'-2'H-chromene) | $-CH_3$ | $-CH_3$ | $-CH_3$ | $C_2H_5COO-$ | -6'-$NO_2$ |
| 28. | 1,3,3-trimethyl-5-ethoxycarbonyl-8'-methoxy-6'-nitrospiro- | | | | | |

-continued

| | | | | | | |
|---|---|---|---|---|---|---|
| | (indoline-2,2'-2-H-chromene) | $-CH_3$ | $-CH_3$ | $-CH_3$ | $C_2H_5COO-$ | -6'-$NO_2$ -8'-$OCH_3$ |
| 29. | 1,3,3-trimethyl-5-ethoxycarbonyl-6',8'-dibromospiro(indoline-2,2'-2'H-chromene) | $-CH_3$ | $-CH_3$ | $CH_3$ | $C_2H_5COO-$ | -6'-Br -8'-Br |
| 30. | 1-benzyl-3,3-dimethyl-6'-nitrospiro(indoline-2,2'-2'H-chromene) | $-CH_2-$ | $-CH_3$ | $-CH_3$ | — | -6'-$NO_2$ |
| 31. | 1-benzyl-3,3-dimethyl-8'-methoxy-6'-nitrospiro(indoline-2,2'-2'H-chromene) | $-CH_2-$ | $-CH_3$ | $-CH_3$ | — | -6'-$NO_2$ -8'-$OCH_3$ |
| 32. | 1-carboxyethyl-3,3-dimethyl-6'-nitrospiro(indoline-2,2'-2'H-chromene) | $-(CH_2)_2COOH$ | $-CH_3$ | $-CH_3$ | — | -6'-$NO_2$ |
| 33. | 1-carboxyethyl-3,3-dimethyl-8'-methoxy-6'-nitrospiro(indoline-2,2'-2'H-chromene) | $-(CH_2)_2COOH$ | $-CH_3$ | $-CH_3$ | — | -6'-$NO_2$ -8'-$OCH_3$ |
| 34. | 1-cyanoethyl-3,3-dimethylspiro(indoline-2,2'-2'H-chromene) | $-(CH_2)_2CN$ | $-CH_3$ | $-CH_3$ | — | — |
| 35. | 1-cyanoethyl-3,3-dimethyl-6'-nitrospiro(indoline-2,2'-2'H-chromene) | $-(CH_2)_2CN$ | $-CH_3$ | $-CH_3$ | — | -6'-$NO_2$ |
| 36. | 1-cyanoethyl-3,3-dimethyl-8'-methoxy-6'nitrospiro-(indoline-2,2'-2'H-chromene) | $-(CH_2)_2CN$ | $-CH_3$ | $-CH_3$ | — | -6'-$NO_2$ -8'-$OCH_3$ |
| 37. | 1-carboxypropyl-3,3-dimethyl-6'-nitrospiro(indoline-2,2'-1'H-chromene) | $-(CH_2)_3COOH$ | $-CH_3$ | $-CH_3$ | — | -6'-$NO_2$ |
| 38. | 1-carboxypropyl-3,3-dimethyl-8'-methoxy-6'-nitrospiro(indoline-2,2'-2'H-chromene) | $-(CH_2)_3COOH$ | $-CH_3$ | $-CH_3$ | — | -6'-$NO_2$ -8'-$OCH_3$ |
| 39. | 1- -carboethoxypropyl-3,3-dimethylspiro(indoline-2,2'-2'H-chromene) | $-(CH_2)_3COOC_2H_5$ | $-CH_3$ | $-CH_3$ | — | — |
| 40. | 1- -carboethoxypropyl-3,3-dimethyl--6'-nitrospiro-(indoline-2,2'-2'H-chromene) | $-(CH_2)_3COOC_2H_5$ | $-CH_3$ | $-CH_3$ | — | -6'-$NO_2$ |
| 41. | 1- - carboethoxypropyl-3,3-dimethyl-8'-methoxy-6'-nitrospiro(indoline-2,2'-2'H-chromene) | $-(CH_2)_3COOC_2H_5$ | $-CH_3$ | $-CH_3$ | — | -6'-$NO_2$ -8'-$OCH_3$ |
| 42. | 1- -bromobuthyl-3,3-dimethyl-spiro(indoline-2,2'-2'H-chromene) | $-(CH_2)_4Br$ | $-CH_3$ | $-CH_3$ | — | — |
| 43. | 1- -bromobuthyl-3,3-dimethyl-6'-nitrospiro(indoline-2,2'-2'H-chromene) | $-(CH_2)_4Br$ | $-CH_3$ | $-CH_3$ | — | -6'-$NO_2$ |
| 44. | 1- -bromobuthyl-3,3-dimethyl-8'-methoxy-6'-nitrospiro(indoline-2,2'-2'H-chromene) | $-(CH_2)_4Br$ | $-CH_3$ | $-CH_3$ | — | -6'-$NO_2$ -8'-$OCH_3$ |
| 45. | 3,3-dimethyl-1-hydroxyethyl-spiro(indoline-2,2'-2'H-chromene) | $-(CH_2)_2OH$ | $-CH_3$ | $-CH_3$ | — | — |
| 46. | 3,3-dimethyl-1-hydroxyethyl-6'-nitrospiro-(indoline-2,2'-2'H-chromene) | $-(CH_2)_2OH$ | $-CH_3$ | $-CH_3$ | — | -6'-$NO_2$ |
| 47. | 3,3-dimethyl-1-hydroxyethyl-8'-methoxy-6'-nitrospiro-(indoline-2,2'-2'H-chromene) | $-(CH_2)_2OH$ | $-CH_3$ | $-CH_3$ | — | -6'-$NO_2$ |
| 48. | 1,1-dimethyl-1-methoxyethyl-6'- | | | | | |

-continued

| | | | | | | |
|---|---|---|---|---|---|---|
| | nitrospiro(indoline-2,2'-2'H-chromene) | $-(CH_2)_2OCH_3$ | $-CH_3$ | $-CH_3$ | — | -6'-$NO_2$ |
| 49. | 3,3-dimethyl-1-methoxyethyl-8'-methoxy-6'-nitrospiro(indoline-2,2'-2'H-chromene) | $-(CH_2)_2OCH_3$ | $-CH_3$ | $-CH_3$ | — | -6'-$NO_2$ -8'-$OCH_3$ |
| 50. | 3,3-dimethyl-1-phenyl-6'-nitrospiro(indoline-2,2'-2'H-chromene) | 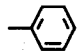 | $-CH_3$ | $-CH_3$ | — | -6'-$NO_2$ |
| 51. | 3,3-dimethyl-1-phenyl-8'-methoxy-6'-nitrospiro(indoline-2,2'-2'H-chromene) | 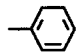 | $-CH_3$ | $-CH_3$ | — | -6'-$NO_2$ -8'-$OCH_3$ |
| 52. | 1,3-dimethyl-3-ethylspiro(indoline-2,2'-2'H-chromene) | $-CH_3$ | $-CH_3$ | $-C_2H_5$ | — | — |
| 53. | 1,3-dimethyl-3-ethyl-6'-nitrospiro(indoline-2,2'-2'H-chromene) | $-CH_3$ | $-CH_3$ | $-C_2H_5$ | — | -6'-$NO_2$ |
| 54. | 1,3-dimethyl-3-ethyl-8'-methoxy-6'-nitrospiro(indoline-2,2'-2'H-chromene) | $-CH_3$ | $-CH_3$ | $-C_2H_5$ | — | -6'-$NO_2$ -8'-$OCH_3$ |
| 55. | 1,3-dimethyl-3-phenyl-6'-nitrospiro(indoline-2,2'-2'H-chromene) | $-CH_3$ | $-CH_3$ | | — | -6'-$NO_2$ |

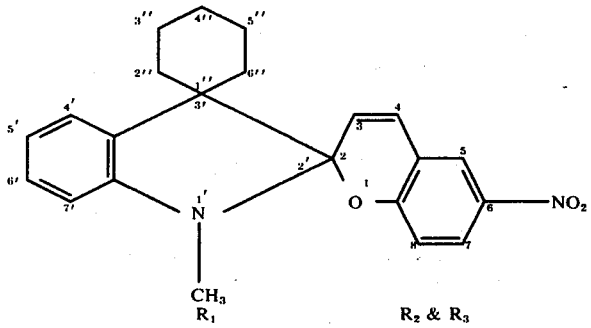

| | | $R_1$ | $R_2$ & $R_3$ | X | Y |
|---|---|---|---|---|---|
| 56. | 1'-methyl-6-nitro-2H-chromene-2-spiro-2'-indoline-3'-spiro-1''-cyclohexane | $-CH_3$ | —cyclohexane | — | -6-$NO_2$ |
| 57. | 1'-methyl-6-nitro-2H-chromene-2-spiro-2'-indoline-3'-spiro-1''-cyclopentane | $-CH_3$ | —cyclopentane | — | -6-$NO_2$ |

There are no limitations on the organic or inorganic acids used to form the quaternary salts. The acids may be organic, inorganic, protonic, or Lewis acids. Examples are as follows. Oxalic acid, acetic acid, benzenesulfonic acid, toluene-sulfonic acid, salicylic acid, picric acid, dimethylsulfuric acid, diethylsulfuric acid, hydrochloric acid, sulfuric acid, nitric acid, perchloric acid, boron trifluoride, stannous chloride, titanium chloride, ferric chloride, phosphoric acid, phosphorous molybdenate, and zinc chloride, etc.

The method of preparing these compounds is illustrated using 1,3,3-trimethyl-6'-nitrospiro(indoline-2,2'-2'H-chromene) as a starting material. 322 g of 1,3,3-trimethyl-6'-nitrospiro(indoline-2,2'-2'H-chromene) was dissolved by heating in 21 of ethanol near the boiling point of the ethanol, and then 30 ml of concentrated hydrochloric acid (the concentration being 12 N hydrochloric acid) was added to the solution to provide a yellow precipitate. The precipitate was separated by filtration, washed with ethanol, and dried. 31.5 g of a solid was obtained. The melting point was of the solid was 260°to 267° C. The infra-red absorption spectra thereof showed absorption at 2400 to 2800 $cm^{-1}$ based on $$C{=}\overset{+}{\underline{N}}{-}H \ ,$$

and halogen was detected by the Beilstein test. An elemental analysis of this solid gave the following results (the calculated values correspond to the salt prepared in the ratio of 1:1 for the compound of this invention to the acid).

| | H(%) | C(%) | H(%) |
|---|---|---|---|
| Calculated values | 7.81 | 63.60 | 5.30 |
| Measured values | 7.68 | 63.02 | 5.17 |

All the above facts suggest the obtained compound to be a salt of 1,3,3-trimethyl-6'-nitrospiro(indoline-2,2'-2'H-chromene) with hydrochloric acid.

In the same manner as above, various salts were synthesized by the reaction of 1,3,3-trimethyl-6'-nitrospiro(indoline-2, 2'-2'H-chromene) with various kinds of acids. Typical examples of the acids are shown in the following table.

| Acid used | Melting Point (° C) of Salt |
|---|---|
| hydrochloric acid | 260–261 |
| sulfuric acid | 225–230 |
| nitric acid | 159–160 |
| perchloric acid | 240–242 |
| oxalic acid | 60–62 |
| acetic acid | 158–160 |
| sulfanyl acid | 220–223 |
| benzenesulfonic acid | 207–209 |
| toluenesulfonic acid | 123–126 |
| dinitro-ortho-cresol | 121–122 |
| picric acid | 230–232 |
| salicylic acid | 142–143 |
| boron trifluoride ethylate | 242–345 |
| ferric chloride | 252–253 |
| titanium trichloride | 257–258 |
| stannous chloride | 220–221 |

Salts of the other compounds shown in the above-described general formula can be prepared in a similar manner and used as photosensitizers.

The salts of indolinospirobenzopyrane thus obtained are effective for sensitizing heterocyclic photoconductive materials such as oxazol compounds, thiazole compounds, imidazole compounds and carbazole compounds, and for sensitizing high-molecular weight photoconductive materials such as polyvinylcarbazole, polyvinylphenothiazine, carbazoleformaldehyde resin, etc. Typically, the molecular weight of the high molecular weight compound is approximately 1,000 to 1,000,000 and preferably approximately 10,000 to 100,000.

The amount of sensitizer used is generally from about 1.0 to about 10 wt% of the photoconductive material(s).

The above described compounds per se have a photosensitizing effect on such organic photoconductive materials, but their quaternary salts were found to have a greatly increased sensitizing effect.

The present invention will now be illustrated in more detail with reference to the following examples, but the invention is not to be limited thereby.

EXAMPLE 1

20 g of poly-N-vinylcarbazole (molecular weight — 70,000) was dissolved in 200 ml of toluene and 100 mg of the benzenesulfonic salt of 1,3,3-trimethyl-6′-nitrospiro(indoline-2,2′-2′H-chromene) dissolved in 5 ml of N-methyl-pryolidone was added to the solution, and the mixture homogenized. The solution was applied to an aluminum-evaporated polyethylene-terephthalate film (Metalmy, manufactured by Tere Kabushiki Kaisha) to yield a dry thickness of 15 $\mu$.

The photosensitive material thus obtained was treated in a conventional electrophotographic technique, i.e. it was charged in a dark place, an image was projected on the film by a a tungsten lamp in an exposure amount of 200 lux-sec., and the film was developed to reproduce a clear image.

Figure 2:
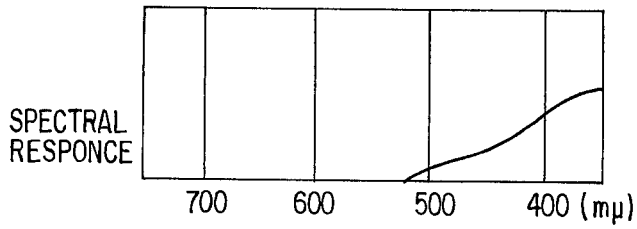
Figure 3:
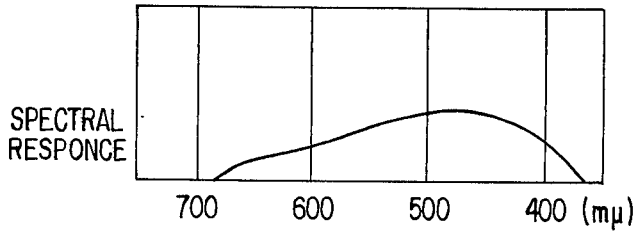

As shown in FIG. 3, the spectral sensitivity of the photosensitive material lies in the region of 380 to 670 m$\mu$. FIG. 1 illustrates the spectral sensitivity of an identical polyvinylcarbazole photosensitive layer but containing no sensitizer, and FIG. 2 illustrates the spectral sensitivity of a layer with 1,3,3-trimethyl-6′-nitrospiro(indoline-2,2′-2′H-chromene) per added thereto. These figures suggest that while a considerable photosensitizing effect is observed in the case of the above photoconductive layer alone, the addition of the salts of the present invention shows a far better sensitizing effect, for otherwise, an exposure amount of 1,000 lux-sec. is required with the material of FIG. 2. That is, in FIG. 2, image exposing is conducted under 1,000 lux-sec., and FIG. 3, 200 lux-sec. Thus, in FIG. 3, a higher sensitivity is obtained in spite of low illuminance and in spite of use of a longer wavelength--that is, in FIG. 1, an ultraviolet ray is used; in FIG. 2, an ultraviolet ray of a visible ray, and in FIG. 3, a visible ray.

EXAMPLE 2

20 g of poly-N-vinylcarbazole was dissolved in 200 ml of toluene and 100 mg of the perchloric acid salt of 1,3,3-trimethyl-6′-nitrospiro(indoline-2,2′-2′H-chromene) dissolved in. 5 ml of N-methylpyrrolidone was then added to the solution whereafter the mixture was homogenized. The solution was then applied on to an aluminum-evaporated polyethylene terephthalate film to a dry thickness of 15 $\mu$. The proper exposure amount of the photosensitive material to obtain a clear image was 180 lux-sec.

EXAMPLE 3

A photosensitive layer was prepared by the same procedure as in Example 1 with the addition of the boron trifluoride salt of 1,3,3-trimethyl-6′-nitrospiro(indoline-2,2′-2′H-chromene) in amount of 1% of the poly-N-vinylcarbazole. An exposure amount of 250 lux-sec. was required to obtain a clear image.

Figure 4:
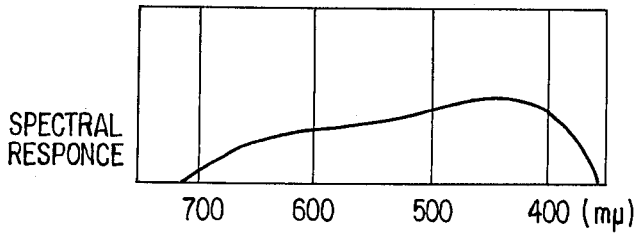

The spectral sensitivity of the photosensitive material containing this sensitizer is illustrated in FIG. 4 where it can be seen that sensitivity characteristics are somewhat better than those of the material of FIG. 3.

EXAMPLE 4

An exposure of 180 lux-sec. was required to obtain a clear image in a photosensitive layer prepared by adding 1.5% of the toluene-sulfonic salt of 1,3,3-trimethyl-6′-nitrospiro(indoline-2,2′-2′H-chromene) to an N-ethylcarbazole-formaldehyde resin (molecular weight — 14,000).

Numerous modifications of the invention will become apparent to one of ordinary skill in the art upon reading the foregoing disclosure. During such a reading it will be evident that this invention provides a unique electrophotographic sensitizer for accomplishing the objects and advantages herein stated.

What is claimed is:

1. An electrophotographic element comprising an electrically conductive support member and a photoconductive layer disposed thereon, said photoconductive layer comprising an admixture of (a) organic photoconductive materials selected from the group of heterocyclic, photoconductive materials and photoconductive materials consisting of high molecular weight of at least 1,000 selected from the group consisting of polyvinyl carbazole, polyvinylphenathiazine and carbazoleformaldehyde resin and (b) quaternary salts formed by the reaction of inorganic or organic acid with indolinospirobenzopyrans, said quaternary salts being from about 1.0 to 10.0% by weight of said photoconductive materials and said indolinospinobenzopyrans being of the general formula

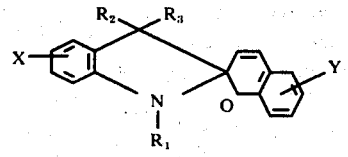

wherein $R_1$ is a phenylradical, an alkyl radical with one to five carbon atoms, or a substituted alkyl radical with one to five carbon atoms where the substitute is a carboxy radical, a cyano radical, an alkoxycarbonyl radical with one to five carbon atoms, a halogen atom, an alkoxy radical with one to five carbon atoms, or a phenyl radical;

$R_2$ and $R_3$ are an alkyl radical with one to five carbon atoms, a phenyl radical, or $R_2+R_3$ can be $(CH_2)_n$ where n is 4 or 5;

X is a hydrogen atom, a nitro radical, a halogen atom, a carboxy radical, an alkoxycarbonyl radical, an alkyl radical with one to five carbon atoms, or a alkoxy radical with one to five carbon atoms; and Y is a hydrogen atom, a nitro radical, a halogen atom, a formyl radical, or an alkoxy radical with one to five carbon atoms.

2. An electrophotographic member for electrophotographic photosensitive materials claimed in claim 1, wherein said inorganic salts is selected from the group consisting of hydrochloric acid, sulfuric acid, nitric acid, pherchloric acid, boron trifluoride, stannous chloride, titanium chloride, ferric chloride, phosphoric acid, phosphorous molybdenate and zinc chloride.

3. An electrophotographic member for electrophotographic photosensitive materials claimed in claim 1, wherein said organic salts is selected from the group consisting of oxalic acid, acetic acid, benzenesulfonic acid, toluene-sulfonic acid, salicylic acid, picric acid, dimethylsulfuric acid and diethylsulfuric acid.

4. An electrophotographic element comprising an electrically conductive support member and a photoconductive layer disposed thereon, said photoconductive layer comprising an admixture of (a) organic photoconductive materials selected from the group consisting of polyvinylcarbazole, polyvinylphenothiazine and carbazoleformaldehyde resin and having a molecular weight from 1,000 to 1,000,000 and (b) quaternary salts formed by the reaction of inorganic or organic acid with indolinospirobenzopyrans, said quaternary salts being from about 1.0 to 10.0% by weight of said photoconductive materials and said indolinospirobenzopyrans being of the general formula

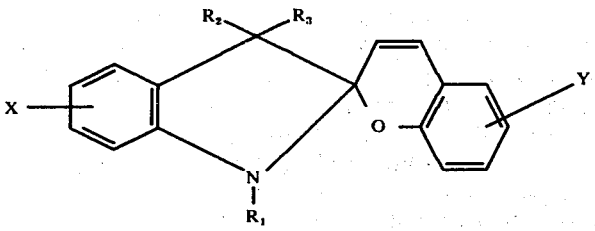

wherein $R_1$ is a phenylradical, an alkyl radical with one to five carbon atoms, or a substituted alkyl radical with one to five carbon atoms where the substitute is a carboxy radical, a cyano radical, an alkoxycarbonyl radical with one to five carbon atoms, a halogen atom, an alkoxy radical with one to five carbon atoms, or a phenyl radical;

$R_2$ and $R_3$ are an alkyl radical with one to five carbon atoms, a phenyl radical, or $R_2+R_3$ can be $(CH_2)_n$ where $n$ is 4 or 5;

X is a hydrogen atom, a nitro radical, a halogen atom, a carboxy radical, an alkoxycarbonyl radical, an alkyl radical with one to five carbon atoms, or an alkoxy radical with one to five carbon atoms; and Y is a hydrogen atom, a nitro radical, a halogen atom, a formyl radical, or an alkoxy radical with one to five carbon atoms.

5. An electrophotographic member for electrophotographic photosensitive materials claimed in claim 1, wherein said photosensitizer contains about 1.0 to about 10 wt% of the photoconductive materials.

6. An electrophotographic process comprising the steps of charging an electrophotographic element comprising an electrically conductive support member and a photoconductive layer disposed thereon, said photoconductive layer comprising an admixture of (a) organic photoconductive materials selected from the group of heterocyclic, photoconductive materials and photoconductive materials consisting of high molecular weight of at least 1,000 selected from the group consisting of polyvinyl carbazole, polyvinylphenathiazine and carbazoleformaldehyde resin and (b) quaternary salts formed by the reaction of inorganic or organic acid with indolinospirobenzopyrans, said quaternary salts being from about 1.0 to 10.0% by weight of said photoconductive materials and said indolinospirobenzopyrans being of the general formula,

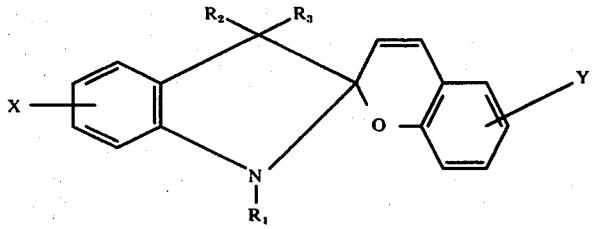

wherein $R_1$ is a phenylradical, an alkyl radical with one to five carbon atoms, or a substituted alkyl radical with one to five carbon atoms where the substituent is a carboxy radical, a cyano radical, an alkoxycarbonyl radical with one to five carbon atoms, a halogen atom, an alkoxy radical with one to five carbon atoms, or a phenyl radical;

$R_2$ and $R_3$ are an alkyl radical with one to five carbon atoms, a phenyl radical, or $R_2+R_3$ can be $(CH_2)_n$ where $n$ is 4 or 5; carboxy radical, an alkoxycarbonyl radical, an alkyl radical with one to five carbon atoms, or an alkoxy radical with one to five carbon atoms; and Y is a hydrogen atom, a nitro radical, a halogen atom, a formyl radical, or an alkoxy radical with one to five carbon atoms, projecting an image on said electrophotographic member, and developing the electrophotographic member to reproduce said image.

7. An electrophotographic process as in claim 6, wherein said inorganic salts is selected from the group consisting of hydrochloric acid, sulfuric acid, nitric acid, pherchloric acid, boron trifluoride, stannous chloride, titanium chloride, ferric chloride, phosphoric acid, phosphorous molybdenate and zinc chloride.

8. An electrophotographic process as in claim 6, wherein said organic salts is selected from the group consisting of oxalic acid, acetic acid, benzenesulfonic acid, toluene-sulfonic acid, salicylic acid, picric acid, dimethylsulfuric acid and diethylsulfuric acid.

9. An electrophotographic process as in claim 6, wherein said photosensitive materials are selected from the group consisting of polyvinylcarbazole, polyvinylphenothiazine and carbazoleformaldehyde resin and have a molecular weight from 1000 to 1,000,000.

10. An electrophotographic process as in claim 6, wherein said photosensitizer contains about 1.0 to about 10 wt% of the photoconductive materials.

* * * * *